US011374365B2

(12) United States Patent
Tsukamoto et al.

(10) Patent No.: US 11,374,365 B2
(45) Date of Patent: Jun. 28, 2022

(54) ELECTRICAL DEVICE CONNECTOR WITH SHIELDING FOR MOUNTING ON A CASE OF A DEVICE

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Yuya Tsukamoto, Mie (JP); Kiyokazu Sakaguchi, Mie (JP); Shuya Nishio, Mie (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 643 days.

(21) Appl. No.: 16/344,848

(22) PCT Filed: Oct. 30, 2017

(86) PCT No.: PCT/JP2017/039036
§ 371 (c)(1),
(2) Date: Apr. 25, 2019

(87) PCT Pub. No.: WO2018/088255
PCT Pub. Date: May 17, 2018

(65) Prior Publication Data

US 2022/0131320 A1 Apr. 28, 2022

(30) Foreign Application Priority Data

Nov. 10, 2016 (JP) ..... JP2016-219363

(51) Int. Cl.
*H01R 13/6593* (2011.01)
*H01R 13/74* (2006.01)
(Continued)

(52) U.S. Cl.
CPC ..... *H01R 13/6593* (2013.01); *H01R 13/748* (2013.01); *H01R 13/648* (2013.01);
(Continued)

(58) Field of Classification Search
CPC ..... H01R 13/6593; H01R 13/748; H01R 13/6592; H01R 13/73; H01R 13/74; H01R 2201/26; H01R 13/648
See application file for complete search history.

(56) References Cited

U.S. PATENT DOCUMENTS 5,197,903 A 3/1993 Casey et al.
2014/0051286 A1 2/2014 Itsuki et al.

FOREIGN PATENT DOCUMENTS

JP 2011-9054 1/2011
JP 2013-229139 11/2013
(Continued)

OTHER PUBLICATIONS

International Search Report dated Jan. 16, 2018.

*Primary Examiner* — Abdullah A Riyami
*Assistant Examiner* — Justin M Kratt
(74) *Attorney, Agent, or Firm* — Gerald E. Hespos; Michael J. Porco

(57) ABSTRACT

A device connector (10) is to be mounted on a case (1) of a device and includes a housing (20) configured to fit into a mounting hole (2) in the case (1). A wire (40) is pulled out from the housing (20) in parallel to an outer surface (4) of the case (1). A shield (50) includes a wire-side mounting portion (53) that is configured to cover the wire (40), and a connecting member (60) configured to coaxially arrange and directly connect a case-side mounting portion (3) projecting in a direction intersecting a pull-out direction of the wire (40) from the outer surface (4) of the case (1) and the wire-side mounting portion (53).

6 Claims, 10 Drawing Sheets

(51) Int. Cl.
*H01R 13/73* (2006.01)
*H01R 13/6592* (2011.01)
*H01R 13/648* (2006.01)

(52) U.S. Cl.
CPC ..... *H01R 13/6592* (2013.01); *H01R 13/73* (2013.01); *H01R 13/74* (2013.01); *H01R 2201/26* (2013.01)

(56) References Cited

FOREIGN PATENT DOCUMENTS

| | | | |
|---|---|---|---|
| JP | 2014-86152 | 5/2014 | |
| JP | 2015-8134 | 1/2015 | |
| JP | 2015-82417 | 4/2015 | |
| WO | 2014/061727 | 4/2014 | |
| WO | WO-2014061727 A1 * | 4/2014 | ..... H01R 13/512 |
| WO | 2015/060113 | 4/2015 | |

* cited by examiner

ELECTRICAL DEVICE CONNECTOR WITH SHIELDING FOR MOUNTING ON A CASE OF A DEVICE

BACKGROUND

Field of the Invention

This specification relates to a device connector.

Related Art

Japanese Unexamined Patent Publication No. 2013-229139 discloses a shield connector to be mounted directly on a device. This shield connector is composed of a male shield connector and a female shield connector. The male shield connector includes a hollow cylindrical male shield shell and the female shield connector includes a vibration reaction-type shield shell. When the male and female shield connectors are connected, the male shield shell and the vibration reaction-type shield shell are connected and shield is dropped from a contact piece of the vibration reaction-type shield shell to a casing.

The above-described shield connector is to be directly mounted on the device, and a connecting direction of the male and female connectors matches a pulled-out direction of shield cables. Thus, the male shield shell and the vibration reaction-type shield shell can be connected directly connected, and there is a merit in that a shield current path length can be shortened. However, a connecting direction of both male and female connectors and a pull-out direction of shield cables may be perpendicular. In this situation, it is necessary to add an L-shaped conductive member between both shield shells for connecting the shield shells. Thus, a shield current path length becomes longer, the number of components is increased; an operation of connecting the conductive member to each shield shell is added.

SUMMARY

This specification relates to a device connector to be mounted on a case of a device and includes a housing that can fit into a mounting hole provided in the case. A wire is pulled out from the housing and is parallel to an outer surface of the case. A shield includes a wire-side mounting portion and is configured to cover the wire a connecting member is configured to coaxially arrange and directly connect a case-side mounting portion projecting in a direction intersecting a pull-out direction of the wire from the outer surface of the case and the wire-side mounting portion.

According to this configuration, the wire-side mounting portion is arranged coaxially with and directly connected to the case-side mounting portion. Thus, a shield current path length from the wire-side mounting portion to the case-side mounting portion can be made shortest, and shielding performance can be improved as compared to the case where a case-side mounting portion and a wire-side mounting portion are connected via an L-shaped conductive member (e.g. an L-shaped shield shell).

The connecting member may include a connecting member body extending straight and having an intermediate part except both end parts embedded in the housing. Bolt holes are provided in both end parts of the connecting member body and open to outside the housing. According to this configuration, the connecting member and the housing can be fixed to the case by bolt-fastening the case-side mounting portion to one end part of the connecting member body and bolt-fastening the wire-side mounting portion to the other end part of the connecting member body.

The bolt holes may be configured as a single bolt hole penetrating in an extending direction of the connecting member body, and the connecting member may be an insert nut including the single bolt hole. According to this configuration, since the bolt holes are configured as the single bolt hole, the case-side mounting portion and the wire-side mounting portion can have an accurate coaxial arrangement.

The shield may include a braided wire configured to cover the wire, a shield shell having the braided wire crimped thereto and the wire-side mounting portion disposed at a position coplanar with an end part of the wire and the case-side mounting portion. According to this configuration, the case-side mounting portion, the wire-side mounting portion and the wire all are disposed in the same plane. Thus, the device connector easily is miniaturized and vibration transmitted from the wire to the housing easily is blocked by the case-side mounting portion.

The device connector may include a cover made of conductive metal. The cover may include a shield connecting portion connected to the case-side mounting portion together with the connecting member and a cover fixing portion fixed to the housing. The cover is not connected to the wire-side mounting portion. According to this configuration, the shield connecting portion is connected to the case-side mounting portion. Thus, the shield current path length can be made shorter as compared to the case where the shield connecting portion is connected to the wire-side mounting portion. Further, since the cover fixed portion is fixed to the housing, the influence of vibration on the cover can be prevented.

According to the device connector disclosed by this specification, shielding performance can be improved by shortening the shield current path length.

DETAILED DESCRIPTION

Figure 9:
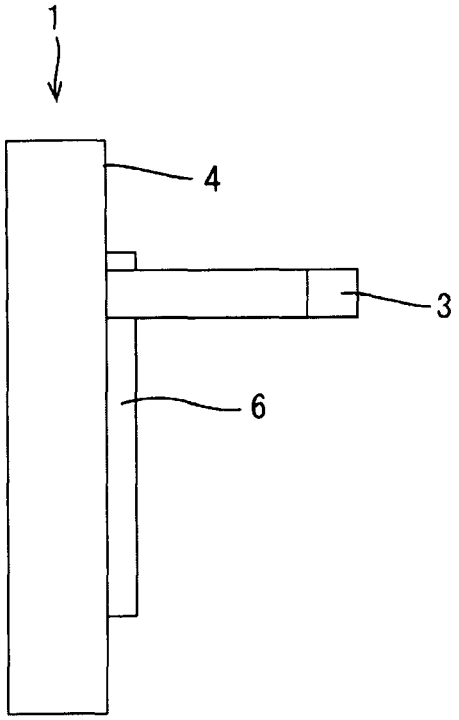
FIG. 9 is a side view of the case of the device.
Figure 10:
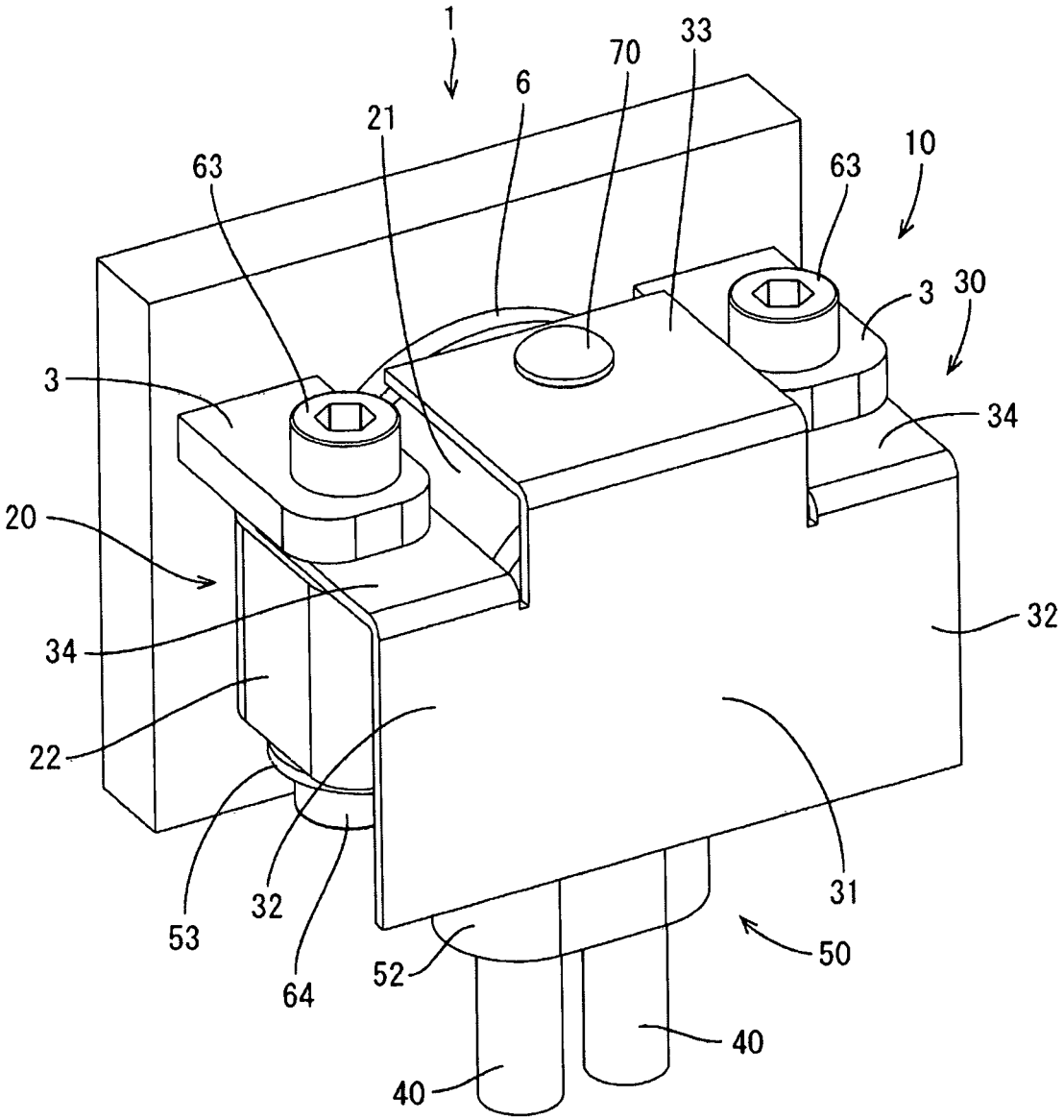
FIG. 10 is a perspective view of the device connector mounted on the case of the device obliquely viewed from behind.
Figure 11:
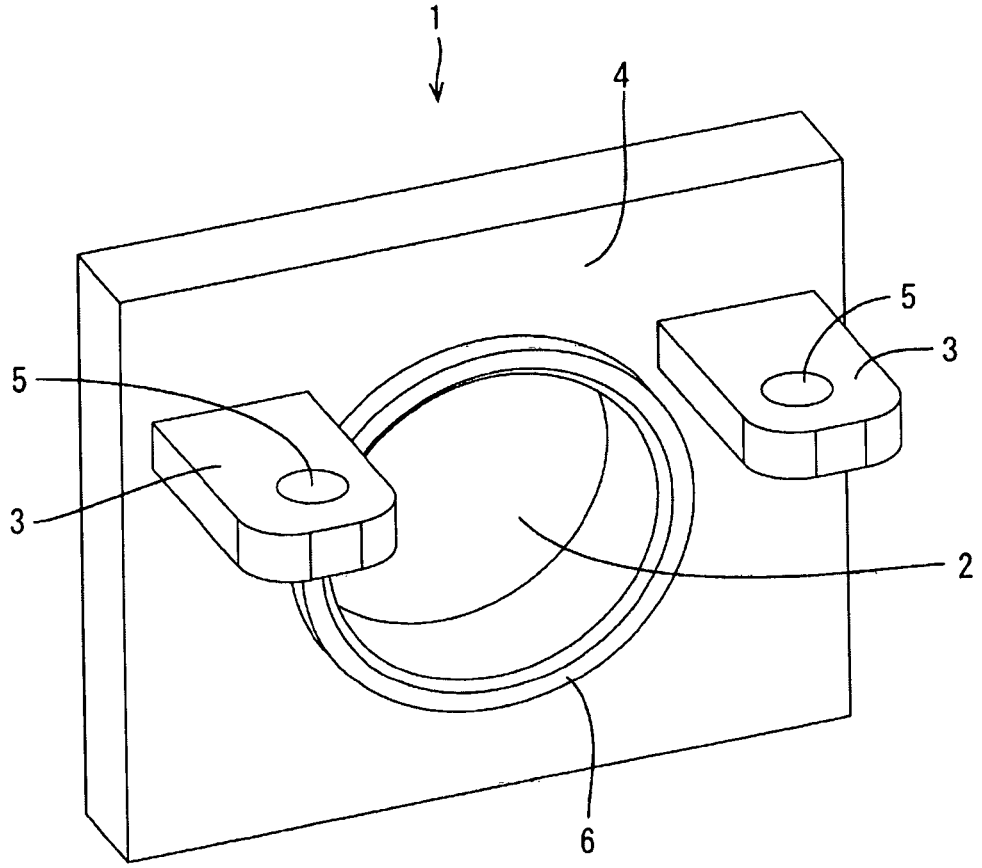
FIG. 11 is a perspective view of the case of the device obliquely viewed from behind.

An embodiment is described with reference to FIGS. 1 to 11. A device connector 10 of this embodiment is a device connector 10 mounted on a case 1 of a device such as an inverter or a motor as shown in FIG. 10. As shown in FIG. 11, the case 1 is provided with a mounting tube 6 having a mounting hole 2 penetrating therethrough. Further, two case-side mounting portions 3 in the form of flat plates project on parts of an outer surface 4 of the case 1 around the mounting hole 2. The case-side mounting portions 3 are coplanar and parallel, and each includes a bolt insertion hole 5 penetrating in a plate thickness direction. Further, as shown in FIG. 9, the case-side mounting portions 3 are perpendicular to the outer surface 4 of the case 1.

Figure 6:
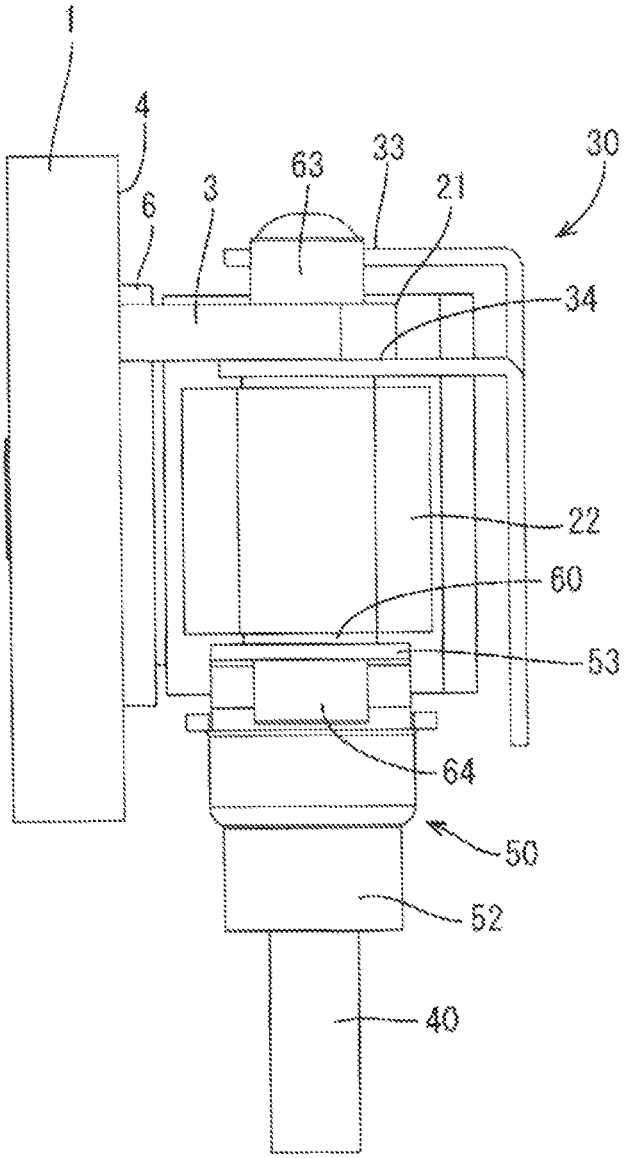
FIG. 6 is a side view showing the device connector mounted on the case of the device.

As shown in FIG. 6, the device connector 10 includes a housing 20 fittable into the mounting hole 2 of the mounting tube 6, a conductive cover 30 for covering the housing 20 from behind, wires 40 pulled out in parallel to the outer surface 4 of the case 1 from the housing 20, a shield 50 for collectively covering the wires 40 and insert nuts 60 embedded in the housing 20. A direction of fitting the housing 20 into the mounting hole 2 of the mounting tube 6 (lateral direction in FIG. 6) is perpendicular to a pull-out direction of the wires 40 (down in FIG. 6).

Figure 1:
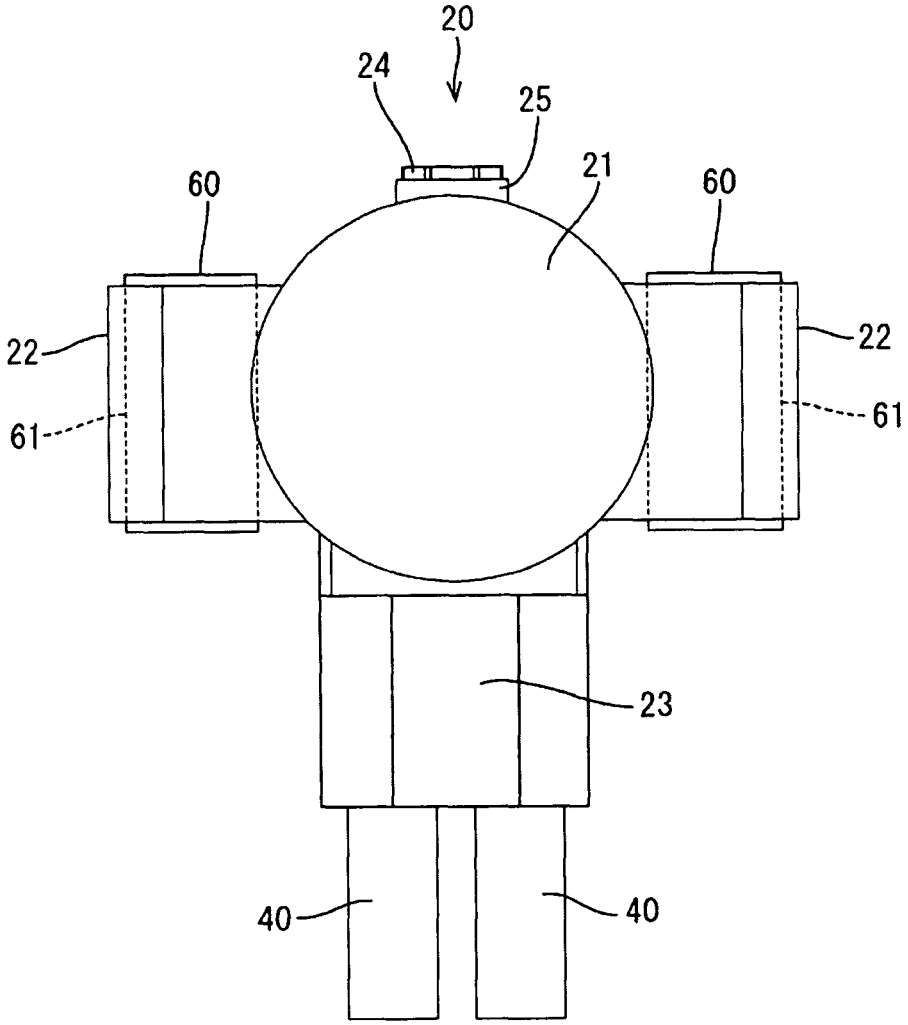
FIG. 1 is a back view of a device connector before a cover and a shield shell are mounted.

The housing 20 is made of synthetic resin and includes, as shown in FIG. 1, a housing body 21 that is circular when viewed from behind. Two flanges 22 protrude toward both left and right sides from the housing body 21, and a wire accommodating portion 23 projects down from the housing body 21. The insert nuts 60 are molded integrally to the flanges 22. Further, end parts of the wires 40 are accommodated inside the wire accommodating portion 23. Although not shown, terminals are connected to the end parts of the wires 40 and are held inside the housing body 21. A nut holding portion 25 projects up atop the housing body 21, and holds a nut 24 by press-fitting or insert molding.

Figure 2:
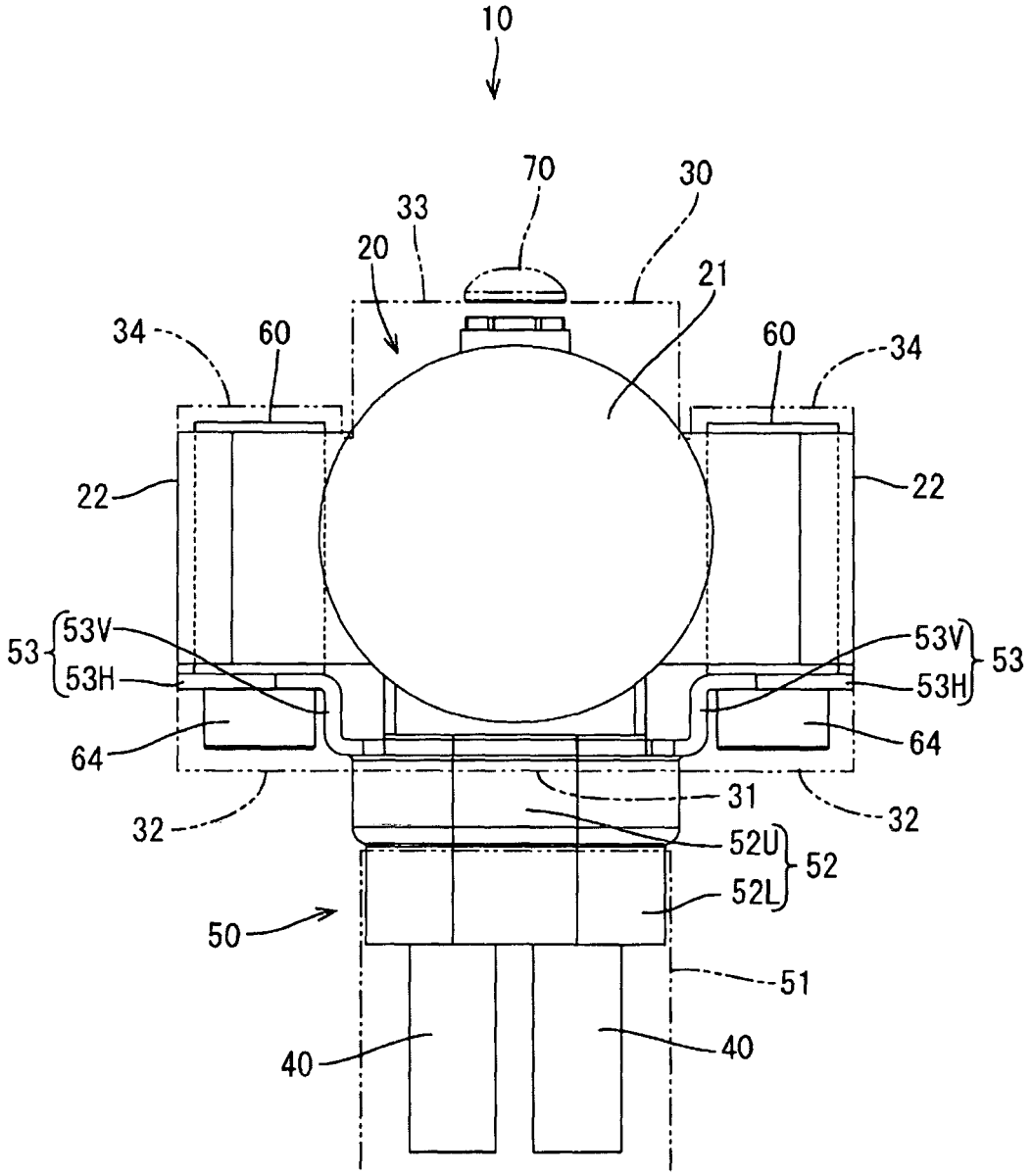
FIG. 2 is a back view showing the device connector before the cover is mounted.
Figure 3:
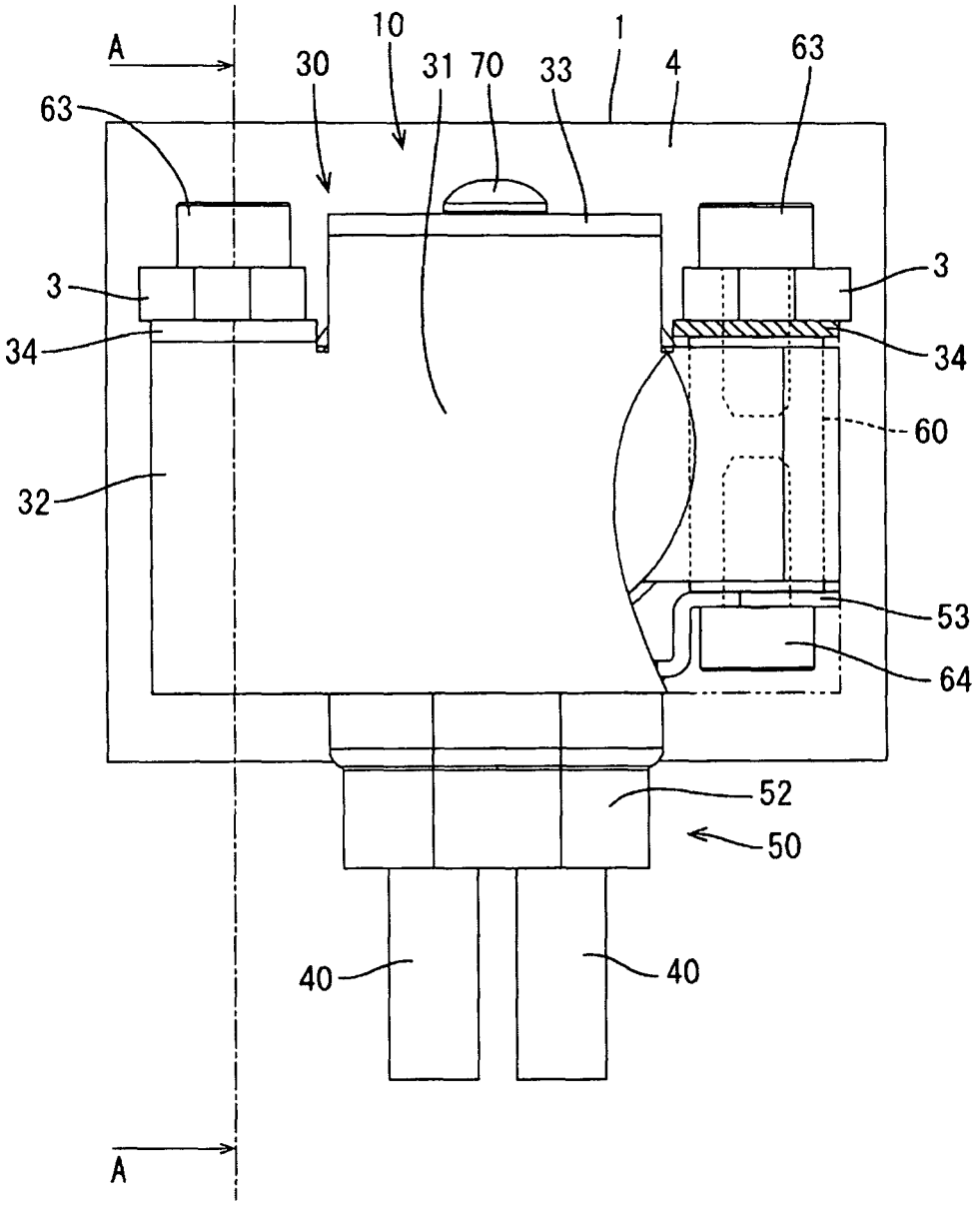
FIG. 3 is a back view partly in section showing the device connector mounted on a case of a device.
Figure 4:
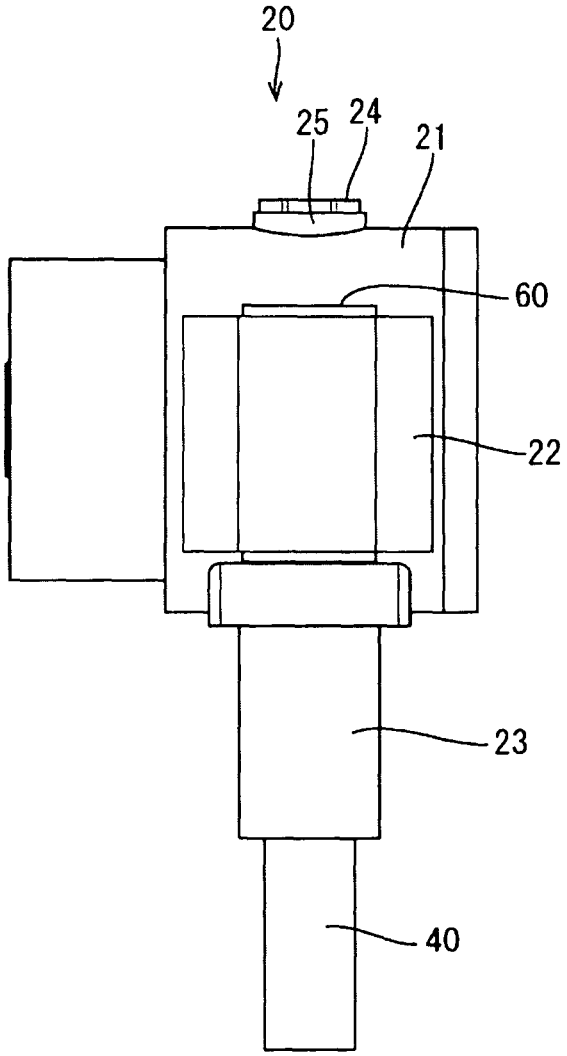
FIG. 4 is a side view showing the device connector before the cover and the shield shell are mounted.
Figure 5:
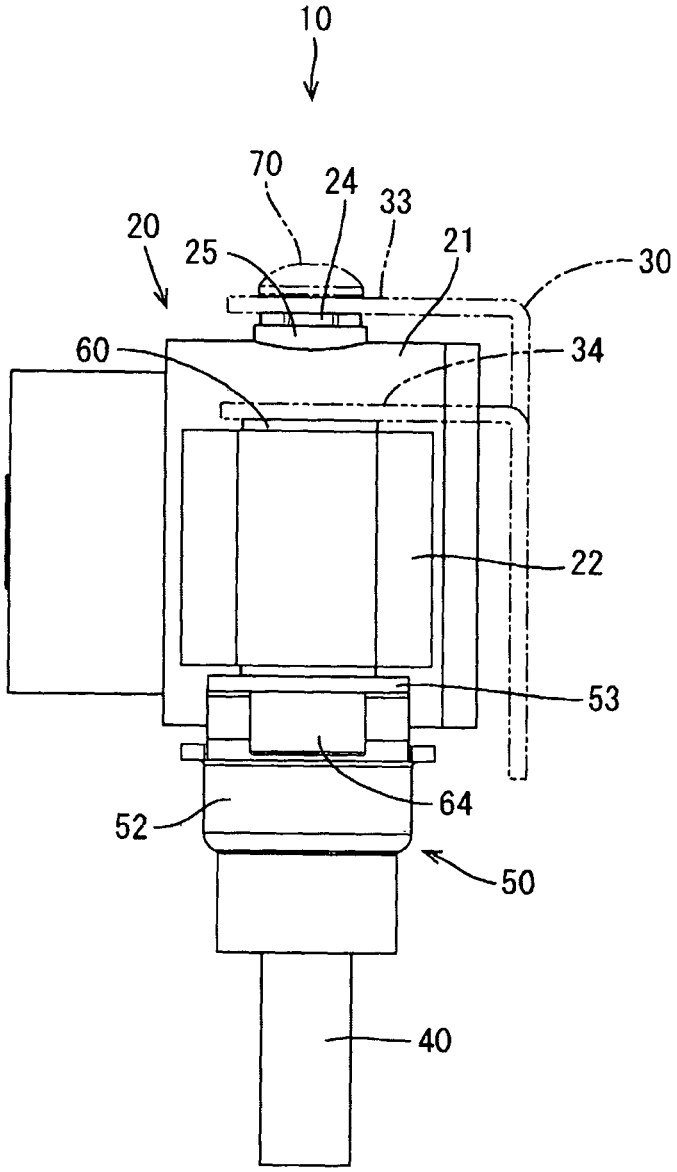
FIG. 5 is a side view showing the device connector before the cover is mounted.

The cover 30 is made of conductive metal and includes, as shown in FIG. 2, a cover body 31 for covering the housing body 21 from behind and two protection walls 32 for covering the flanges 22 from behind. As shown in FIG. 6, a cover fixing portion 33 in the form of a flat plate projects forward on the upper edge of the cover body 31. On the other hand, two shield connecting portions 34 in the form of flat plates project forward on the upper edges of the protection walls 32. As shown in FIG. 2, the cover fixing portion 33 is fixed to the housing 20 by tightening a fixing bolt 70 into the nut 24.

As shown in FIG. 2, the shield 50 includes a braided wire 51 for collectively covering the wires 40, a shield shell 52 having the braided wire 51 connected thereto and two wire-side mounting portions 53 provided continuously with the shield shell 52.

The shield shell 52 is made of conductive metal and is formed into a tubular shape to surround the wire accommodating portion 23 of the housing 20 over the entire periphery. The shield shell 52 is composed of a lower tube portion 52L to which the braided wire 51 is crimped by an unillustrated crimp ring and an upper tube portion 52U having a larger diameter than the lower tube portion 52L and provided with the two wire-side mounting portions 53.

The wire-side mounting portions 53 are disposed on both left and right sides of an upper end opening of the upper tube portion 52U. The wire-side mounting portion 53 is composed of a vertical part 53V projecting vertically from the upper end opening of the upper tube 52U and a horizontal part 53H projecting in a horizontal direction from an upper end part of the vertical part 53V. The horizontal parts 53H of the respective wire-side mounting portions 53 project in directions opposite to each other.

Figure 7:
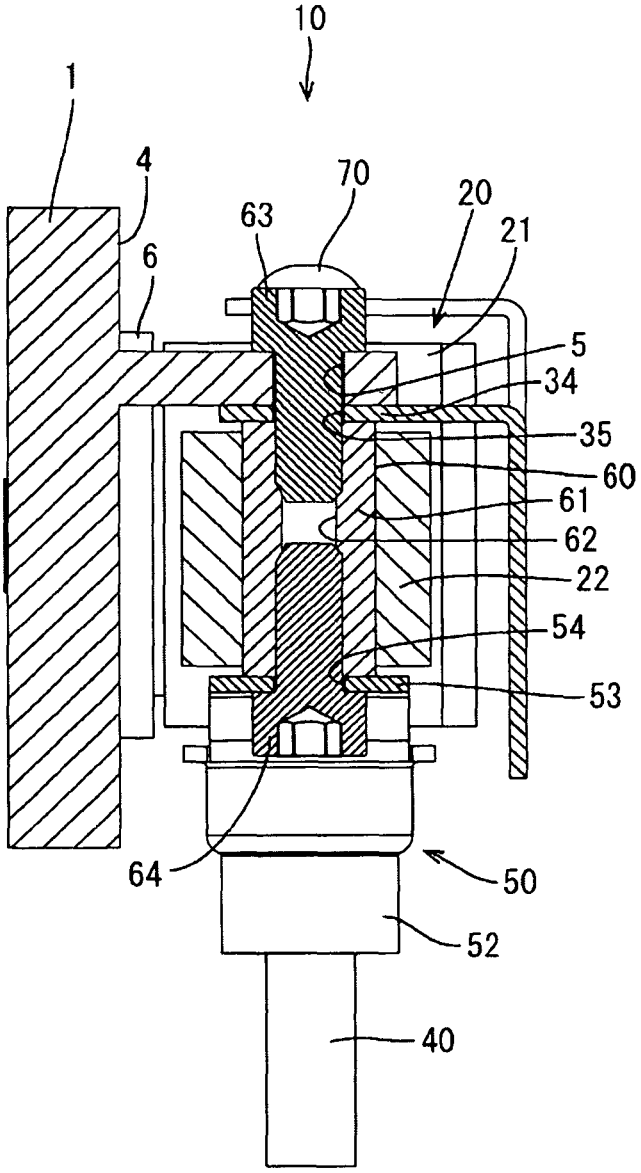
FIG. 7 is a section along A-A in FIG. 3.
Figure 8:
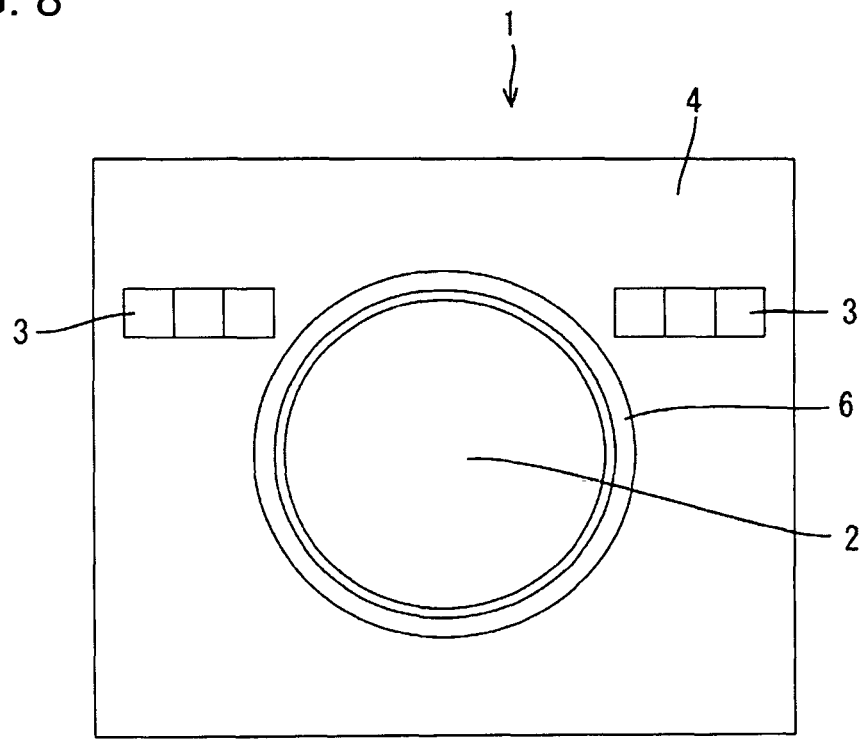
FIG. 8 is a front view of the case of the device.

The insert nut 60 is made of conductive metal and includes, as shown in FIG. 7, a connecting member body 61 extending straight and fixed to the flange 22 at an intermediate part except both end parts. A single bolt hole 62 is provided inside the connecting member body 61 and is open in both upper and lower sides of the flange 22. An external thread is formed on the inner peripheral surface of the bolt hole 62. An upper bolt 63 is engaged threadedly with an upper side of the bolt hole 62 from above and a lower bolt 64 is engaged threadedly with a lower side of the bolt hole 62 from below.

The shield connecting portion 34 of the cover 30 is disposed on an upper part of the connecting member body 61, and the case-side mounting portion 3 of the case 1 is disposed on the upper surface of the shield connecting portion 34. The bolt insertion hole 5 of the case-side mounting portion 3 and a bolt insertion hole 35 of the shield connecting portion 34 are substantially coaxial with the bolt hole 62 of the insert nut 60. Thus, if the upper bolt 63 is inserted into the respective bolt insertion holes 5, 35 and tightened into the bolt hole 62 of the insert nut 60, the case-side mounting portion 3 and the shield connecting portion 34 are fixed and conductively connected to the upper end part of the connecting member body 61.

The wire-side mounting portion 53 of the shield shell 52 is disposed in a lower part of the connecting member body 61. The bolt insertion hole 54 of the wire-side mounting portion 53 and the bolt hole 62 of the insert nut 60 are substantially coaxial. Thus, if the lower bolt 64 is inserted into the bolt insertion hole 54 and tightened into the bolt hole 62 of the insert nut 60, the wire-side mounting portion 53 is connected fixed and conductively to the lower part of the connecting member body 61. In this way, the upper bolt 63 and the lower bolt 64 are arranged coaxially via the insert nut 60, and the case-side mounting portion 3 and the wire-side mounting portion 53 can be arranged coaxially and connected directly. By doing so, the shield shell 52 is connected at the shortest distance 53 to the case-side mounting portions 3 via the insert nuts 60 from the wire-side mounting portions 53 without via the cover 30. Thus, a shield current path length from the braided wire 51 to the case 1 can be shortened and, consequently, shielding performance can be improved.

The wire-side mounting portions 53 are coplanar with the end parts of the wires 40 and the case-side mounting portions 3. In other words, when the device connector 10 is viewed laterally, bolt fastening portions of the case-side mounting portions 3, bolt fastening portions of the wire-side mounting portions 53 and the wires 40 are aligned in a straight line in a direction parallel to the outer surface 4 of the case 1. According to this arrangement, a dimension of the device connector 10 in a front-rear direction becomes smaller and the rigidity of the device connector 10 is enhanced. In addition, fastening points (entire insert nuts 60 in this embodiment) can be brought close to a center of gravity of the device connector 10, vibration transmitted from the wires 40 to the housing 20 can be blocked in a moment by the two case-side mounting portions 3 and the two insert nuts 60.

According to the device connector 10 of this embodiment, the vibration resistance and resistance to electromagnetic noise of an L-shaped connector are improved despite difficulties to combine vibration resistance and resistance to electromagnetic noise. Thus, a special effect of being able to prevent a connection failure to a device mating side due to the vibration of the wires 40 and a device-side malfunction due to electromagnetic noise can be exhibited.

As described above, the wire-side mounting portions 53 are coaxial with and directly connected to the case-side mounting portions 3. Thus, the shield current path length becomes shorter and shielding performance is improved as compared to the situation where case-side mounting portions and wire-side mounting portions are connected via L-shaped conductive members (e.g. L-shaped shield shells).

The connecting member (insert nut 60) may include the connecting member body 61 extending straight and having the intermediate part except the end parts embedded in the housing 20, and has the bolt holes open to the outside of the housing 20 and provided in the end parts of the connecting member body 61. According to this configuration, the connecting member and the housing 20 can be fixed to the case 1 by bolt-fastening the case-side mounting portion 3 to one end part of the connecting member body 61 and bolt-fastening the wire-side mounting portion 53 to the other end part of the connecting member body 61.

The bolt holes may be configured as the single bolt hole 62 penetrating in an extending direction of the connecting member body 61, and the connecting member may be the insert nut 60 including the single bolt hole 62. According to this configuration, the case-side mounting portion 3 and the wire-side mounting portion 53 can be accurately coaxial.

The shield member 50 may include the braided wire 51 for covering the wires 40, the shield shell 52 having the braided wire 51 crimped thereto and the wire-side mounting portions 53 disposed at the positions coplanar with the end parts of the wires 40 and the case-side mounting portions 3. According to this configuration, the device connector 10 easily is miniaturized and vibration transmitted from the wires 40 to the housing 20 easily is blocked by the case-side mounting portions 3.

The cover 30 made of conductive metal may include the shield connecting portions 34 connected to the case-side mounting portions 3 together with the connecting members and the cover fixing portion 33 fixed to the housing 20 and may not be connected to the wire-side mounting portions 53. According to this configuration, the shield current path length can be made shorter as compared to the case where the shield connecting portions 34 are connected to the wire-side mounting portions 53. Further, since the cover fixing portion 33 is fixed to the housing 20, the influence of vibration on the cover 30 can be prevented.

The invention is not limited to the above described and illustrated embodiment. For example, the following modes also are included.

Although the insert nuts 60 are insert-molded to the housing 20, the insert nuts 60 may be fixed to the housing 20 by press-fitting.

Although the insert nut 60 including the single bolt hole 62 is illustrated in the above embodiment, a pair of bolt holes respectively open in both end parts of the connecting member body 61 may be provided.

Although the shield 50 with the braided wire 51 for collectively covering the wires 40 is illustrated in the above embodiment, a shield pipe for collectively covering the wires 40 may be used instead of the braided wire 51.

Although the wire-side mounting portions 53 disposed at the positions coplanar with the end parts of the wires 40 and the case-side mounting portions 3 are illustrated in the above embodiment, the end parts of the wires 40 may be located behind the wire-side mounting portions 53.

Although the device connector 10 with the cover 30 made of conductive metal is illustrated in the above embodiment, a device connector may not include the cover 30 or may use a cover formed such as by plating conductive metal on a surface of a resin member.

Although the cover 30 is connected only to the case-side mounting portions 3 in the above embodiment, a cover connected to both the case-side mounting portions 3 and the wire-side mounting portion 53 may be used.

LIST OF REFERENCE SIGNS

1 case
2 mounting hole
4 outer surface
10 device connector
20 housing
30 cover
33 cover fixing portion
34 shield connecting portion
40 wire
50 shield
51 braided wire
52 shield shell
53 wire-side mounting portion
60 insert nut (connecting member)
61 connecting member body
62 bolt hole

The invention claimed is:

1. A device connector to be mounted on a case of a device, comprising:

a housing configured to fit into a mounting hole provided in the case;

a wire pulled out in parallel to an outer surface of the case from the housing;

a shield including a wire-side mounting portion and configured to cover the wire; and a connecting member configured to coaxially arrange and directly connect a case-side mounting portion projecting in a direction intersecting a pull-out direction of the wire from the outer surface of the case and the wire-side mounting portion;

the connecting member being linearly embedded in the housing, the case-side mounting portion being conductively fixed to one end part of the connecting member, the wire-side mounting portion being conductively fixed to the other end part of the connecting member.

2. The device connector of claim 1, wherein the connecting member includes a connecting member body extending straight and having opposite end parts and an intermediate part between the opposite end parts, the intermediate part being embedded in the housing, and two bolt holes formed respectively in the opposite end parts of the connecting member body, the two bolt holes being open to outside of the housing.

3. The device connector of claim 2, wherein the bolt holes are opposite end portions of a single bolt hole penetrating in an extending direction of the connecting member body, and the connecting member is an insert nut including the single bolt hole.

4. The device connector of claim 3, wherein the shield includes a braided wire configured to cover the wire, a shield shell having the braided wire crimped thereto and the wire-side mounting portion disposed at a position coplanar with an end part of the wire and the case-side mounting portion.

5. The device connector of claim 4, comprising a cover made of conductive metal and including a shield connecting portion connected to the case-side mounting portion together with the connecting member and a cover fixing portion fixed to the housing, the cover being not connected to the wire-side mounting portion.

6. The device connector of claim 1, comprising a cover made of conductive metal and including a shield connecting portion connected to the case-side mounting portion together with the connecting member and a cover fixing portion fixed to the housing, the cover being not connected to the wire-side mounting portion.

* * * * *